US009282820B2

(12) United States Patent
Lo

(10) Patent No.: US 9,282,820 B2
(45) Date of Patent: Mar. 15, 2016

(54) MODULAR RACK ASSEMBLY

(71) Applicant: Zhiqiang Lo, Shenzhen (CN)

(72) Inventor: Zhiqiang Lo, Shenzhen (CN)

(73) Assignee: Seville Classics, Inc., Torrance, CA (US)

( * ) Notice: Subject to any disclaimer, the term of this patent is extended or adjusted under 35 U.S.C. 154(b) by 0 days.

(21) Appl. No.: 14/015,737

(22) Filed: Aug. 30, 2013

(65) Prior Publication Data

US 2015/0014263 A1 Jan. 15, 2015

(30) Foreign Application Priority Data

Jul. 11, 2013 (CN) ..... 2013 2 0411031 U

(51) Int. Cl.

| | |
|---|---|
| ***A47B 43/00*** | (2006.01) |
| ***A47B 47/00*** | (2006.01) |
| ***A47B 57/00*** | (2006.01) |
| ***A47B 87/02*** | (2006.01) |
| ***A47F 5/01*** | (2006.01) |
| ***A47F 5/14*** | (2006.01) |
| ***A47F 5/00*** | (2006.01) |
| ***A47B 47/02*** | (2006.01) |
| *A47F 5/13* | (2006.01) |

(52) U.S. Cl.

CPC ..... *A47B 87/0207* (2013.01); *A47B 47/0083* (2013.01); *A47B 47/024* (2013.01); *A47F 5/0018* (2013.01); *A47F 5/01* (2013.01); *A47F 5/14* (2013.01); *A47F 5/13* (2013.01)

(58) Field of Classification Search

CPC ..... A47B 57/30; A47B 57/32; A47B 57/34; A47B 57/36; A47B 57/38; A47B 57/40; A47B 57/48; A47B 57/482; A47B 57/00; A47B 57/06; A47B 57/08; A47B 57/10; A47B 57/12; A47B 57/14; A47B 57/16; A47B 57/20; A47B 47/00; A47B 47/0083; A47B 47/021; A47B 47/024; A47B 47/025; A47B 87/0207; A47B 27/02; A47B 87/0215; A47B 87/0223; A47B 2087/023; A47B 2087/0238; A47B 87/0246; A47B 87/0253; A47B 87/0276; A47B 47/0091; A47F 5/10; A47F 3/06; A47F 5/0018; A47F 5/0043

USPC ..... 211/188, 194, 186, 187, 189, 190, 191, 211/192, 149, 150, 182; 108/147.13, 108/106–110, 147.12, 147.14–147.17, 152, 108/187, 193; 248/243–245, 250

See application file for complete search history.

(56) References Cited

U.S. PATENT DOCUMENTS

| | | | | | |
|---|---|---|---|---|---|
| 1,373,781 | A | * | 4/1921 | Wagner | 108/109 |
| 2,714,540 | A | | 8/1955 | Diehm | |
| 3,042,221 | A | | 7/1962 | Rasmussen | |
| 3,104,626 | A | * | 9/1963 | Brunette | 108/106 |
| 3,146,734 | A | | 9/1964 | Sol Kesilman et al. | |
| 3,266,635 | A | | 8/1966 | McConnell | |
| 3,285,428 | A | | 11/1966 | Scheck | |
| 3,463,325 | A | | 8/1969 | Rogers et al. | |
| 3,536,016 | A | * | 10/1970 | Chesley | 108/181 |

(Continued)

*Primary Examiner* — Jennifer E Novosad
(74) *Attorney, Agent, or Firm* — Raymond Sun

(57) ABSTRACT

A rack assembly has two support frames, each support frame having at least one connecting member comprising a short tube welded on the support frame and an insertion tube inserted in the short tube. At least one shelf is positioned between the two support frames, each end of each shelf having at least one hook that is received in a corresponding short tube to detachably connect the shelf with the support frame. The shelves can be conveniently attached and detached from the support frames.

13 Claims, 9 Drawing Sheets

(56) References Cited

U.S. PATENT DOCUMENTS

| | | | | | |
|---|---|---|---|---|---|
| 4,078,664 | A | | 3/1978 | McConnell | |
| 4,257,333 | A | | 3/1981 | Pollack | |
| 4,391,378 | A | * | 7/1983 | Secon | 211/187 |
| D278,196 | S | | 4/1985 | Koves | |
| 4,582,001 | A | * | 4/1986 | Leikarts | 108/106 |
| 4,635,563 | A | | 1/1987 | Hand et al. | |
| 4,637,323 | A | | 1/1987 | Nicely | |
| D291,165 | S | | 8/1987 | Ray | |
| D292,658 | S | | 11/1987 | Kester | |
| 4,750,626 | A | * | 6/1988 | Nicely | 211/187 |
| D301,413 | S | | 6/1989 | Rosen | |
| 4,852,501 | A | | 8/1989 | Olsen et al. | |
| 4,955,490 | A | | 9/1990 | Schafer | |
| 4,964,350 | A | | 10/1990 | Kolvites et al. | |
| D314,679 | S | | 2/1991 | Kee | |
| D314,682 | S | | 2/1991 | Kellems et al. | |
| 4,996,929 | A | * | 3/1991 | Saal | 108/107 |
| D319,362 | S | | 8/1991 | Kellems et al. | |
| D322,726 | S | | 12/1991 | Rademacher et al. | |
| 5,174,200 | A | * | 12/1992 | Jeandel et al. | 108/187 |
| 5,279,231 | A | | 1/1994 | Kolvites et al. | |
| 5,423,251 | A | | 6/1995 | Kolvites et al. | |
| D364,055 | S | | 11/1995 | Pakla | |
| D378,331 | S | | 3/1997 | Allendorph | |
| 5,628,415 | A | | 5/1997 | Mulholland | |
| 5,706,741 | A | * | 1/1998 | Thorp et al. | 108/193 |
| 5,913,270 | A | | 6/1999 | Price | |
| 5,924,581 | A | | 7/1999 | Chen | |
| D424,836 | S | | 5/2000 | Kopala, Jr. | |
| 6,079,575 | A | | 6/2000 | Wang | |
| 6,105,798 | A | | 8/2000 | Gruber et al. | |
| D432,820 | S | | 10/2000 | Walters-Dowding et al. | |
| 6,173,846 | B1 | | 1/2001 | Anderson | |
| D440,793 | S | | 4/2001 | Iannaccone | |
| 6,216,894 | B1 | * | 4/2001 | Hendricks | 211/194 |
| 6,241,108 | B1 | * | 6/2001 | Nakatani et al. | 211/187 |
| D444,975 | S | | 7/2001 | West | |
| 6,253,933 | B1 | * | 7/2001 | Yang | 211/187 |
| 6,260,488 | B1 | | 7/2001 | Yang et al. | |
| 6,422,406 | B1 | | 7/2002 | Kessel et al. | |
| 6,431,090 | B1 | * | 8/2002 | Davis et al. | 108/107 |
| D471,033 | S | | 3/2003 | Yamaguchi | |
| 6,561,107 | B1 | | 5/2003 | Wood et al. | |
| D485,092 | S | | 1/2004 | Rosen | |
| D501,738 | S | | 2/2005 | Clucas | |
| 6,899,237 | B2 | | 5/2005 | Trent | |
| 6,971,528 | B2 | * | 12/2005 | Chen | 211/182 |
| 7,059,484 | B1 | * | 6/2006 | Goldberg | 211/187 |
| D528,342 | S | | 9/2006 | Yu | |
| D540,568 | S | | 4/2007 | Clucas | |
| D543,056 | S | | 5/2007 | Chou | |
| 7,252,202 | B2 | * | 8/2007 | Saltzberg et al. | 211/187 |
| D569,180 | S | | 5/2008 | Rathburn | |
| 7,516,856 | B2 | | 4/2009 | Lee et al. | |
| D597,342 | S | | 8/2009 | Dickson | |
| D602,712 | S | | 10/2009 | Ho | |
| D626,356 | S | | 11/2010 | Ho | |
| 7,832,571 | B2 | * | 11/2010 | Felsenthal | 211/134 |
| 7,891,507 | B2 | | 2/2011 | Shelter | |
| D637,427 | S | | 5/2011 | Troyner et al. | |
| 8,042,477 | B2 | * | 10/2011 | Lee | 108/147.12 |
| D657,979 | S | | 4/2012 | Sokol et al. | |
| D683,160 | S | | 5/2013 | Williams et al. | |
| D683,983 | S | | 6/2013 | Troyner et al. | |
| 8,616,138 | B1 | * | 12/2013 | Fu | 108/147.13 |
| 2001/0047970 | A1 | * | 12/2001 | McBride | 211/85.11 |
| 2002/0074304 | A1 | * | 6/2002 | Hardy | 211/188 |
| 2003/0131767 | A1 | | 7/2003 | Chen | |
| 2004/0065633 | A1 | | 4/2004 | Chen | |
| 2005/0056604 | A1 | * | 3/2005 | Chen | 211/182 |
| 2005/0092706 | A1 | * | 5/2005 | Chang | 211/187 |
| 2005/0103734 | A1 | * | 5/2005 | Saltzberg et al. | 211/187 |
| 2007/0034584 | A1 | * | 2/2007 | Park | 211/187 |
| 2008/0121600 | A1 | * | 5/2008 | Korte et al. | 211/187 |
| 2008/0156759 | A1 | * | 7/2008 | Lai | 211/187 |
| 2009/0152225 | A1 | | 6/2009 | Lee | |
| 2009/0184076 | A1 | * | 7/2009 | Lee | 211/103 |
| 2010/0181274 | A1 | | 7/2010 | Vargo et al. | |
| 2010/0243591 | A1 | * | 9/2010 | Kessell et al. | 211/134 |
| 2011/0036798 | A1 | * | 2/2011 | Chen | 211/188 |
| 2011/0233164 | A1 | * | 9/2011 | Chang | 211/188 |

* cited by examiner

MODULAR RACK ASSEMBLY

BACKGROUND OF THE INVENTION

1. Field of the Invention

The present invention relates to a rack, and in particular, to a modular rack that may be freely assembled into different shapes according to the desired placement space.

2. Description of the Related Art

As one of many conventional organizer products, shoe racks have been used in numerous homes. Conventional shoe racks are typically provided in a fixed shape. Consumers may assemble and combine shoes racks into a fixed shape with tools according to instructional drawings and fittings provided by manufacturers after purchase, or purchase a fully-assembled shoe rack for direct use. Although all of these conventional shoe racks perform the basic functions of a shoe rack, they cannot be freely assembled, dis-assembled and expanded, thereby being monotonous in shape and inconvenient in use.

SUMMARY OF THE INVENTION

To overcome the above-mentioned deficiencies, an object of the present invention is to provide a modular rack that may be easily assembled and dis-assembled without the use of any tools.

To accomplish these objectives, the present invention provides a rack that has support frames that are provided with connecting members and connecting holes. Hooks are provided on the shelves, so that the support frames can connect and disconnect with the shelves conveniently. When multiple layers of connecting members of different vertical heights are provided on the support frames, a multi-layer rack may be freely combined, assembled and disassembled conveniently.

To achieve the above purpose, the present invention provides a freely-combinable rack that comprises at least two support frames and at least one shelf connected with the two support frames. Each support frame has at least one connecting member, each end of the support frames is provided with at least one hook detachably connected with the connecting members on the support frames, the support frames are detachably connected with the shelf, and the connecting member comprises a short tube welded on or otherwise secured to the support frame and an insertion tube inserted in the short tube.

Each support frame comprises two identical vertical tubes and at least one horizontal tube for connecting the two vertical tubes, at least one connecting member is disposed on the medial surface of each vertical tube, the vertical heights of the connecting members disposed on the two vertical tubes are the same; and two ends of each shelf are provided with hooks for detachable connection with corresponding connecting members disposed on the support frames.

The short tube is welded onto or otherwise secured to the medial face of each vertical tube of the support frames, and the cross-section of the short tube can be square or rectangular.

An insertion hole is provided at the upper end of each vertical tube forming the support frames, while a threaded hole is provided at the lower end thereof; and when there are two or more support frames connected in a stacked manner with one above and one below, each vertical tube is connected with a corresponding vertical tube above or beneath this vertical tube by a connector.

The connector comprises a screw rod and a connection peg.

Two or more than two connecting members are provided on the medial face of each vertical tube forming the support frames, and the vertical heights of the connecting members on each vertical tube are the same as those of the connecting members at corresponding vertical positions on the other vertical tube.

There are two horizontal tubes for connecting the two vertical tubes on each support frame, one of the horizontal tubes is connected with the top medial faces of the two vertical tubes, while the other one thereof is connected with the lower medial faces of the two vertical tubes; and the connecting members provided on the medial faces of the vertical tubes are located on connecting portions between the two horizontal tubes and the vertical tubes.

The present invention provides the following advantages. The medial surface of each support frame is provided thereon with multiple layers of hooks. Each of the multiple layers comprises two hooks disposed at corresponding positions on medial faces of two vertical tubes on the same support frame, so that multiple shelves may be placed to form a multi-layer rack. Insertion holes are provided at upper ends of the vertical tubes forming each support frame, while threaded holes are provided at lower ends thereof, so that each support frame can be conveniently extended upwards by connectors. Multiple layers of connecting members, disposed on the medial face of each support frame, may be detachably connected with the shelves on the left and right sides of the support frame, so that the rack may be extended left and right. Compared with the conventional racks, the rack of the present invention may be assembled into various shapes at will without using any tools, and both the assembly and disassembly thereof are convenient.

DESCRIPTION OF THE PREFERRED EMBODIMENTS

Figure 1:
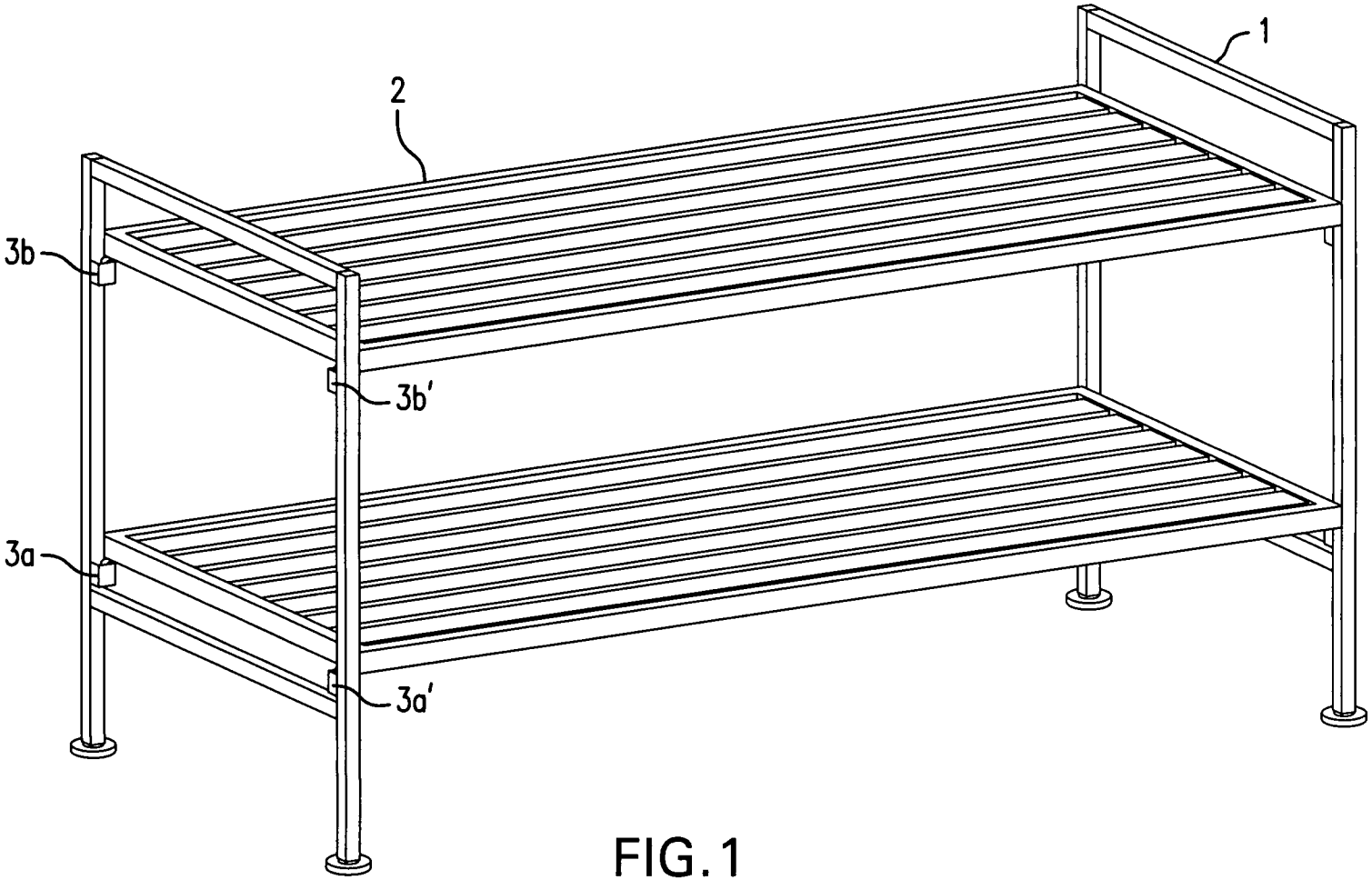
FIG. 1 is a perspective view of a rack according to the present invention.
Figure 2A:
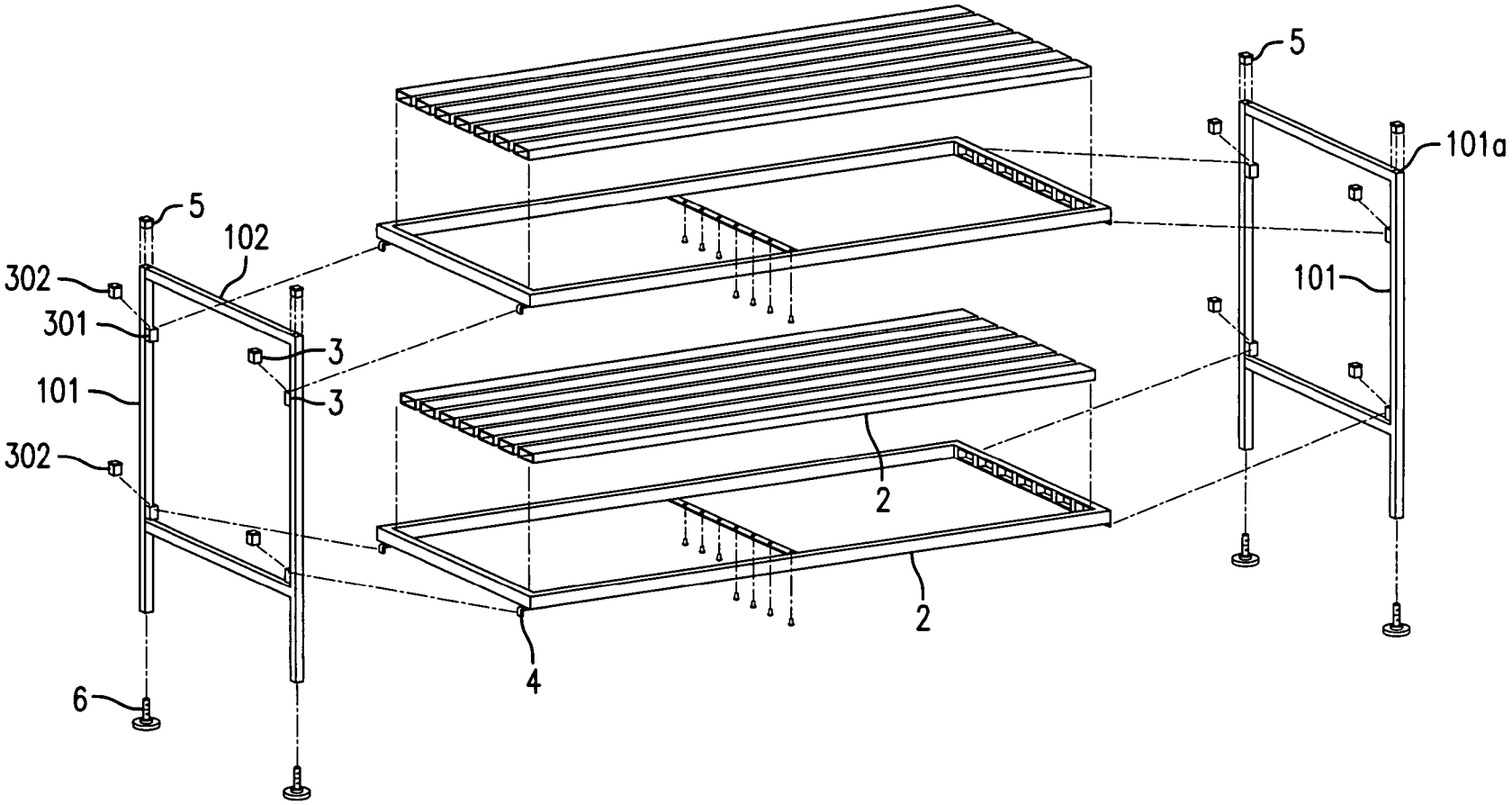
FIG. 2A is an exploded view of the rack of FIG. 1.
Figure 2B:
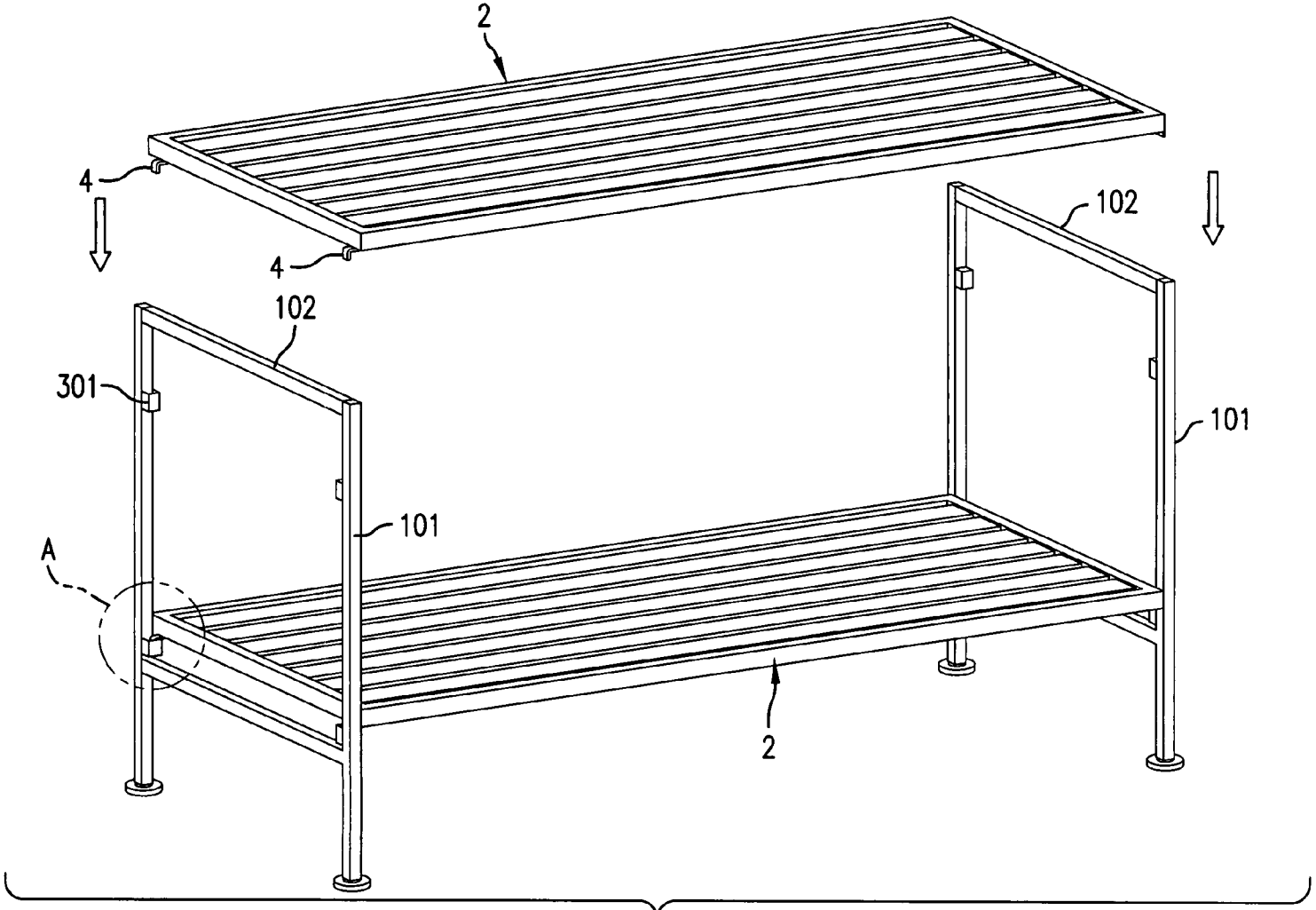
FIG. 2B is another exploded view of the rack of FIG. 1.

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Even though the present invention is illustrated as being used as a shoe rack, it is also possible to use the rack of the present invention for purposes other than for storing or organizing shoes.

As shown in FIG. 1, FIG. 2A, FIG. 2B, FIG. 7 and FIG. 8, a basic module of the rack according to the present invention can include two support frames 1 and two shelves 2 connected between the two support frames 1. Each support frame 1 comprises two identical vertical tubes 101 and two horizontal tubes 102 for connecting the two vertical tubes 101. Two connecting members 3 are provided on the medial surface or wall 109 (i.e., the surface or wall that faces the opposite vertical tube 10 of the same support frame 1) of each vertical tube 101. The vertical height 101 the locations of the connecting members 3 on the two vertical tubes 101 are the same; in other words, the location of the connecting members 3*a*, 3*b* on the left vertical tube 101 are at the same vertical level as that of the connecting members 3*a*', 3*b*' correspondingly disposed on the medial face of the right vertical tube 101. Each end of each shelf 2 is provided with two hooks 4 for detachable connection with corresponding connecting members 3 disposed on the support frames 1, so that the shelves 2 can be detachably connected between two support frames 1.

As shown in FIG. 2, each connecting member 3 can include a short tube 301 with a square or rectangular cross-section, that is welded on the medial face of the corresponding vertical tube 101 (i.e., facing the opposite vertical tube 101), and an insertion tube 302 that is adapted to be inserted in the short tube 301. The hooks 4 are welded on lower surfaces of the end frames of the shelves 2, slightly offset from the corner thereof, and each hook 4 is adapted to be fitted into a corresponding insertion tube 302. The short tubes 301 and the insertion tubes 302 are sized and configured to allow two hooks 4 to fit inside on a side-by-side basis.

Figure 8:
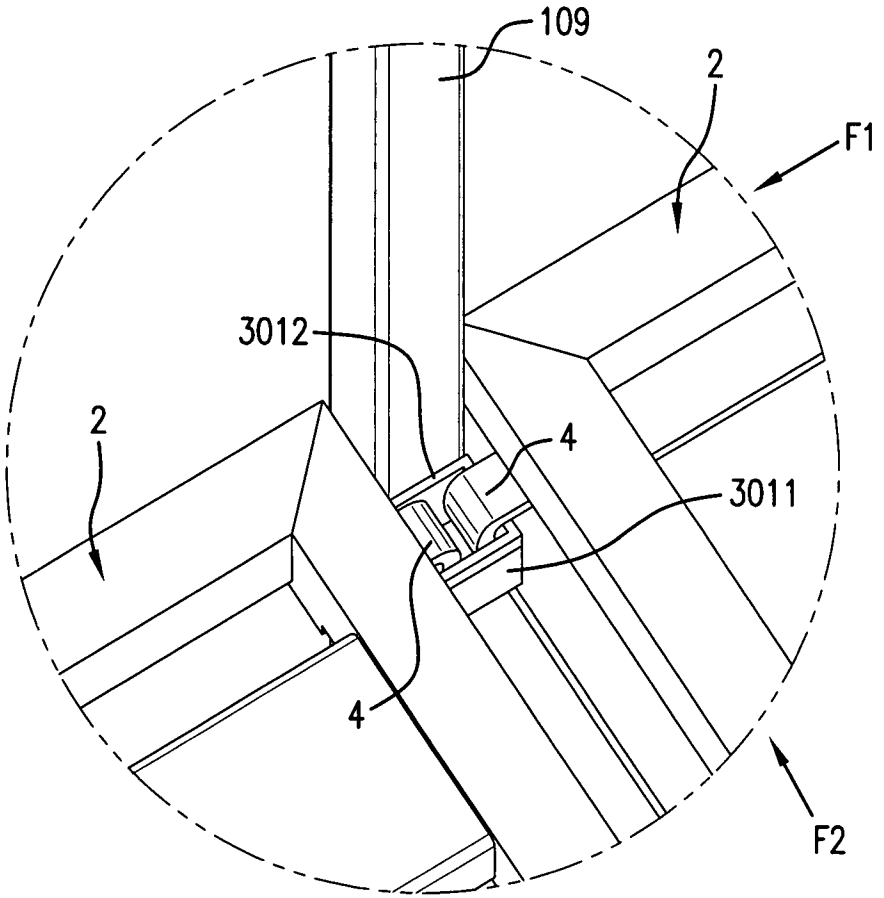
FIG. 8 is an enlarged view illustrating the side-by-side connection of shelves in FIG. 5.

Even though the drawings show the short tubes 301 as being four-sided, it is possible for the short tubes 301 to assume any configuration that has opposing straight segments. As shown in FIG. 8, the two opposing straight segments would be segments 3011 and 3012, which happen to be opposite sides of the square shown in FIG. 8 for the short tube 301.

There are two horizontal tubes 102 on each support frame 1 for connecting the two vertical tubes 101. One of the horizontal tubes 102 is connected with the top medial faces of the two vertical tubes 101, respectively, while the other horizontal tube 102 is connected with the lower medial faces of the two vertical tubes 101. The connecting members 3 disposed on the medial faces of the vertical tubes 101 are located at connecting portions between the two horizontal tubes 102 and the vertical tubes 101.

Insertion holes 101*a* are provided at upper ends of all vertical tubes 101 forming the support frames 1, while threaded holes (not shown) are provided at lower ends of the vertical tubes 101. The insertion holes 101*a* are sealed by detachably connected plugs 5. Each threaded hole at the bottom of the vertical tubes 101 is detachably connected with a foot 6.

The shelves 2 can be conventional shelves, or can be the shelves illustrated in U.S. Pub. No. 2011/0290740-A1, whose disclosure is incorporated by this reference as though set forth fully herein.

Figure 7:
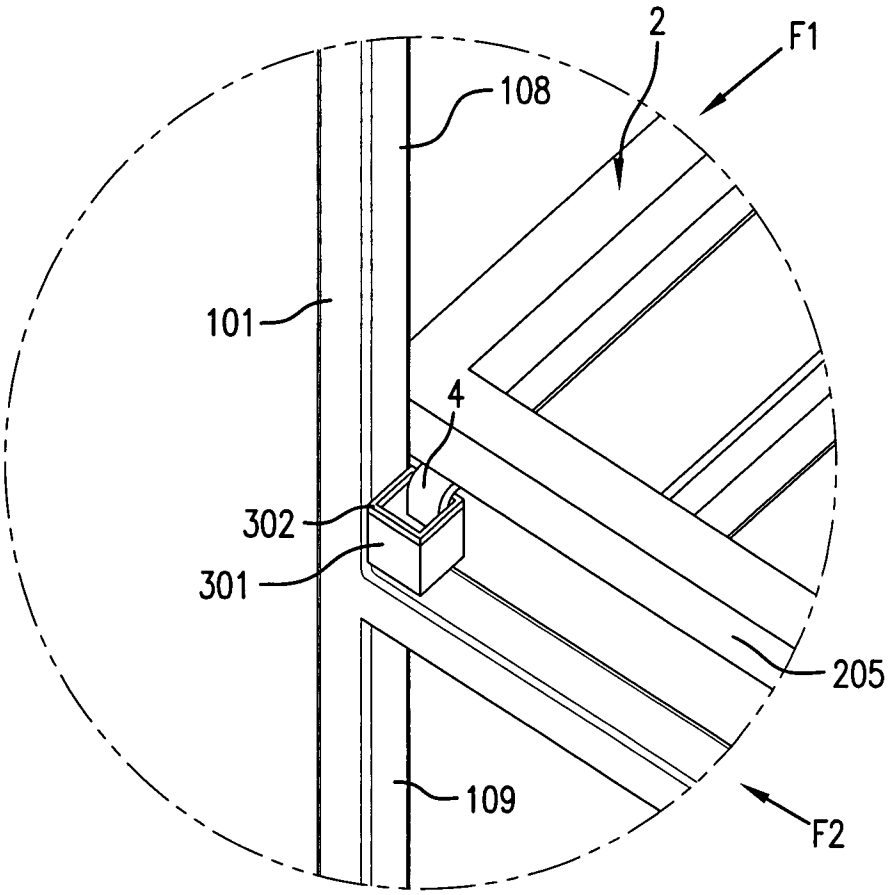
FIG. 7 is an enlarged view of the area labeled A in FIG. 2B.

The present invention provides a unique mechanical interlocking assembly which allows two support frames 1 to support two or more shelves 2 in a stable manner without the use of any further rear or front support or bar that would otherwise be needed to couple the two support frames 1. Referring to FIG. 7 and FIG. 8, the fitting of the hook 4 into the corresponding short tube 301creates two transverse engagement forces F1 and F2. F1 is the engagement of the outer surface 205 of the end wall of the shelf 2 (and in particular, at the corner of the shelf 2) against one wall 108 of the vertical tube 101, and F2 is the engagement of the side of the hook 4 against another wall 109 (that is adjacent and transverse to the wall 108) of the vertical tube 101. The hook 4 is positioned on the end of the shelf 2 at a location that is slightly offset from the corner of the shelf 2 so as to facilitate this interlocking engagement between the hook 4, the outer surface 205, and the walls 108 and 109. The transverse engagement forces F1 and F2 at the four corners of each shelf 2 allow the shelves 2 and the support frames 1 to be secured in a stable manner without the need for any rear bracing.

Figure 3:
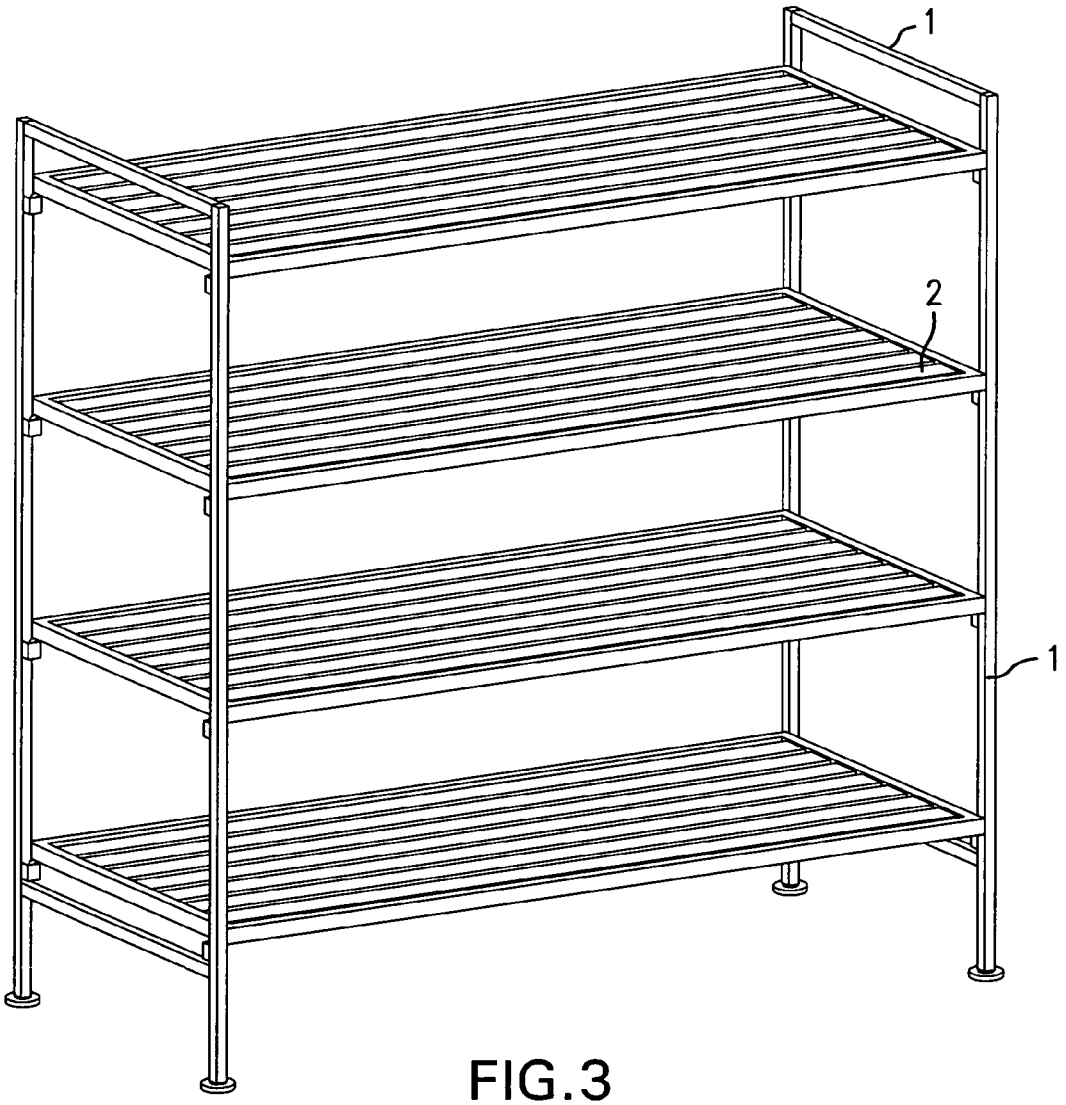
FIG. 3 is a perspective view illustrating a multi-layer rack formed of a plurality of the racks of FIG. 1 stacked vertically.
Figure 4:
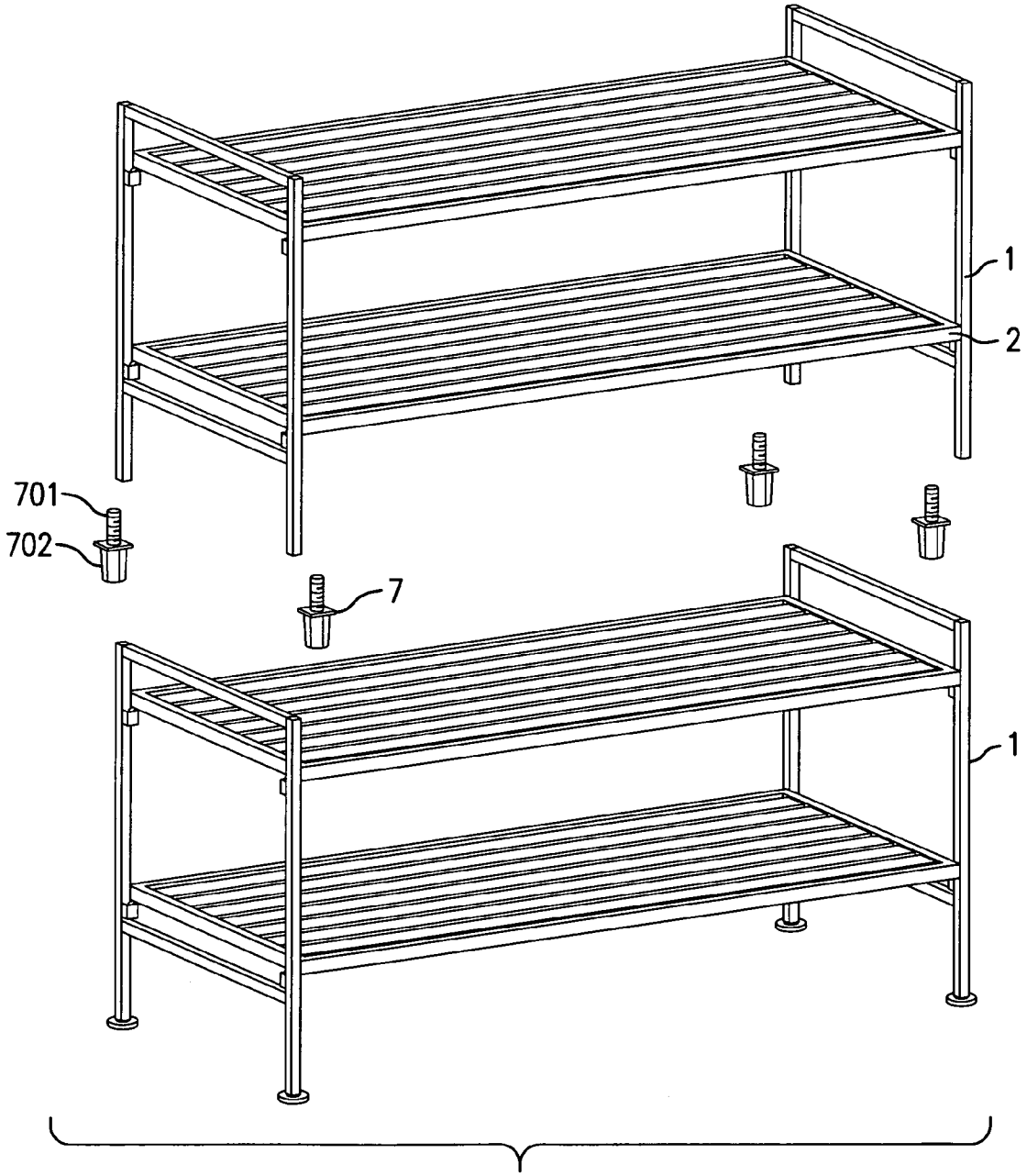
FIG. 4 is an exploded view of a multi-layer rack of FIG. 3.

As shown in FIG. 3 to FIG. 4, two or more support frames 1 can be connected in a stacked fashion (i.e., one connected above the other), the top of each vertical tube 101 of the lower support frame 1 is connected with a corresponding vertical tube 101 of the upper support frame 1 by a connector 7 that comprises a screw rod 701 (which screws into the threaded hole at the bottom of the vertical tube 101) and a connection peg 702 (which can be inserted into the insertion holes 101 at the top of the lower support frame 1).

Figure 5:
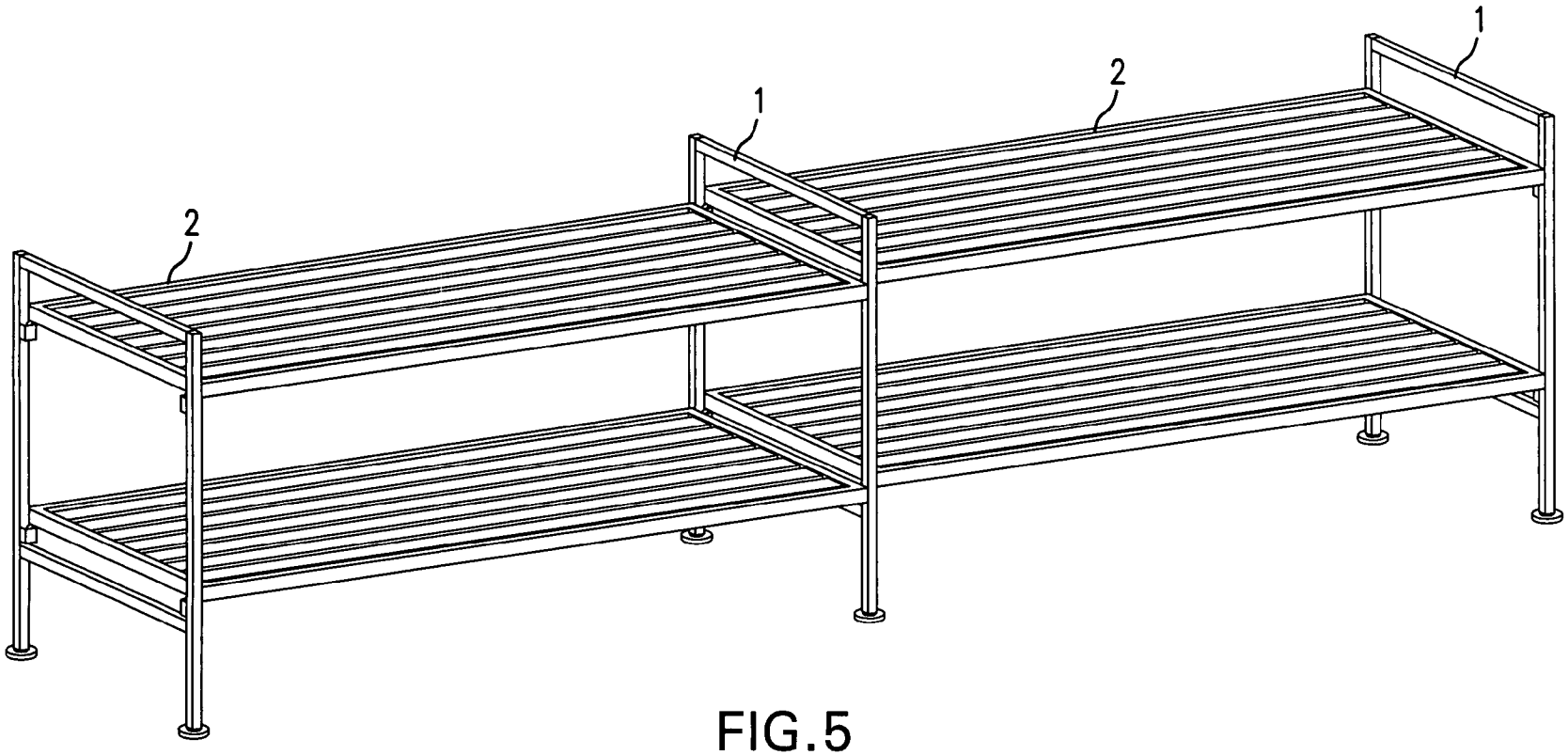
FIG. 5 is a perspective view illustrating another rack formed by assembling a plurality of the racks of FIG. 1 side-by-side thereof.

FIG. 5 and FIG. 8 illustrate how the rack of the present invention can be extended sideways. A common support frame 1 (see the center support frame 1 in FIG. 5) can be used to support the ends of two adjacent shelves 2 by inserting the hooks 4 of the two adjacent shelves 2 into the short tubes 301 and the insertion tubes 302 of the common (i.e., the center) support frame 1.

Figure 6:
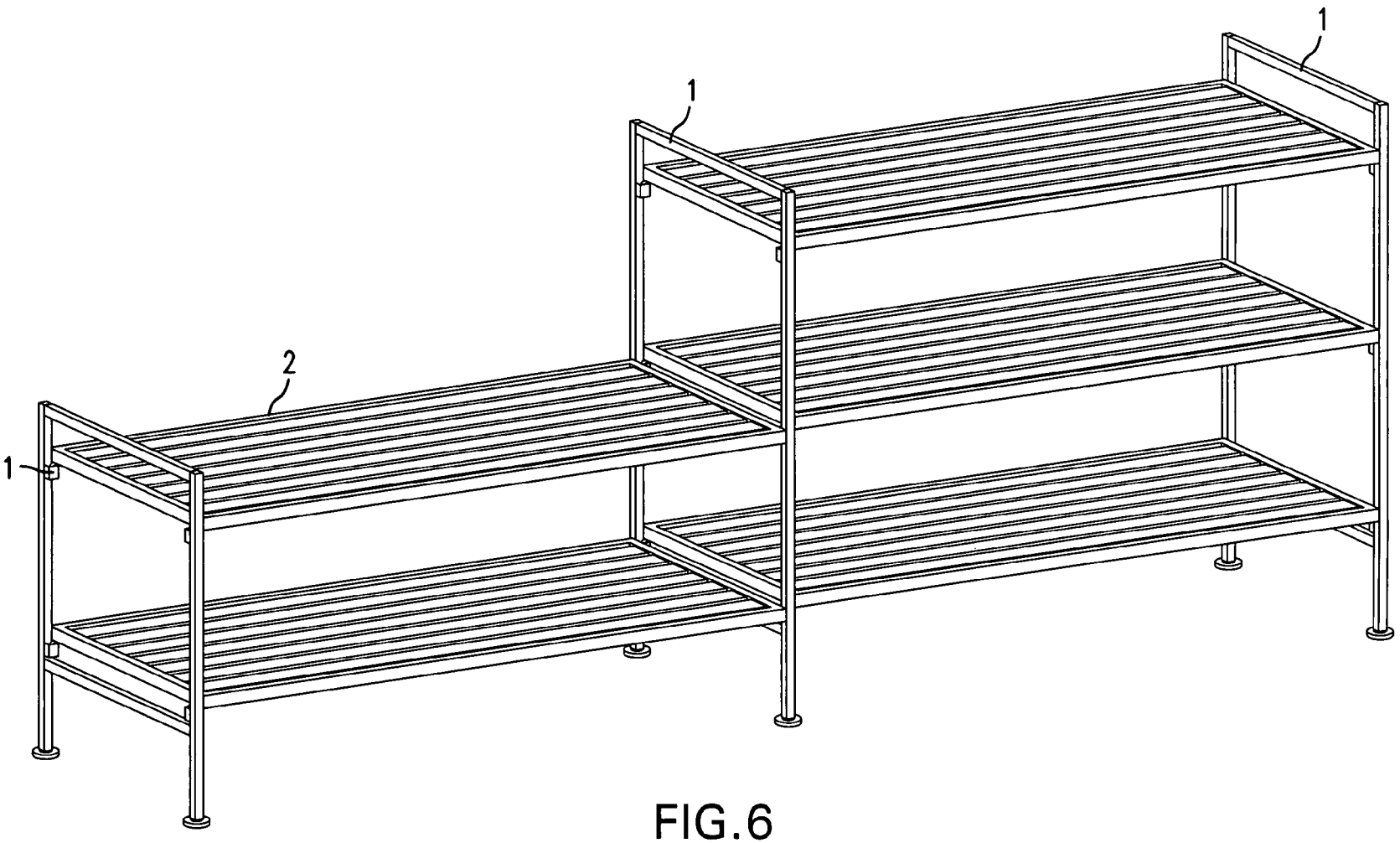
FIG. 6 is a perspective view illustrating yet another rack formed by assembling a plurality of the racks of FIG. 1 stacked vertically and connected on the sides thereof.

FIG. 6 illustrates a rack that is formed by incorporating the stacking and connection principles shown in FIGS. 4 and 5.

While the description above refers to particular embodiments of the present invention, it will be understood that many modifications may be made without departing from the spirit thereof.

What is claimed is:

1. A rack assembly, comprising:

two support frames, each support frame having at least one connecting member comprising a first tube secured to the support frame, the first tube having an inner space with an opening that opens upwardly, and a separate insertion tube having an internal space with an opening that opens upwardly, wherein the insertion tube is inserted through the opening of the first tube and fits completely inside the inner space of the first tube; and at least one shelf positioned between the two support frames, each end of each shelf having at least one hook that is inserted through the opening of a corresponding insertion tube and received in the corresponding insertion tube to detachably connect the shelf with the support frame.

2. The assembly of claim 1, wherein each support frame comprises two identical vertical tubes and at least one horizontal tube for connecting the two vertical tubes, wherein each vertical tube has a medial surface, and the at least one connecting member is disposed on the medial surface of each vertical tube, with the connecting members disposed on the two vertical tubes positioned at the same vertical heights.

3. The assembly of claim 2, wherein each vertical tube, has a medial surface, and the first tube is secured to the medial surface of each vertical tube of the support frames, and the first tube has a four-sided cross-section.

4. The assembly of claim 2, wherein an insertion hole is provided at the upper end of each vertical tube, and a threaded hole is provided at the lower end each vertical tube, and wherein a connector is coupled to the upper end of each vertical tube.

5. The assembly of claim 4, wherein the connector comprises a screw rod and a connection peg.

6. The assembly of claim 1, wherein the insertion tube is snuggly fitted inside the first tube.

7. The assembly of claim 1, wherein a portion of the hook rests on an edge of the insertion tube at the opening of the insertion tube.

8. A rack assembly, comprising:

two support frames, each support frame comprising two identical vertical tubes and at least one horizontal tube for connecting the two vertical tubes, each vertical tube having two connecting members provided thereon, and with each of the connecting members on each vertical tube aligned at the same vertical height as a corresponding connecting member on the other vertical tube, each connecting member including a first tube that is secured to the vertical tube in a manner such that the first tubes of a vertical tube are facing the first tubes of the other vertical tube of the same support frame, each first tube having an inner space with an opening that opens upwardly, each connecting member also including a separate insertion tube having an internal space with an opening that opens upwardly, wherein the insertion tube is inserted through the opening of a corresponding first tube and into the inner space of that first tube; and at least one shelf positioned between the two support frames, each shelf having an end wall, each end wall of each shelf having two hooks, with each hook secured to the corresponding end wall of the shelf at a location slightly offset from the corresponding corner of the shelf, and each hook is inserted through the opening of a corresponding insertion tube and received in the corresponding insertion tube to detachably connect the shelf with the support frame.

9. The assembly of claim 8, wherein the end wall of the shelf at a corner of the shelf exerts a first engagement force on a first wall of the vertical tube, and a side of the hook exerts a second engagement force on an adjacent second wall of the vertical tube that is perpendicular to the first wall, with the first and second engagement forces being transverse to each other.

10. The assembly of claim 9, wherein each insertion tube is configured with two opposing straight segments that are adapted to contact the opposite sides of one of the hooks.

11. The assembly of claim 8, wherein each insertion tube is configured with two opposing straight segments that are adapted to contact the opposite sides of one of the hooks.

12. The assembly of claim 8, wherein the insertion tube is snuggly fitted inside the first tube.

13. The assembly of claim 8, wherein a portion of the hook rests on an edge of the insertion tube at the opening of the insertion tube.

* * * * *